US005807664A

United States Patent [19]

Suzuki

[11] Patent Number: 5,807,664

[45] Date of Patent: Sep. 15, 1998

[54] SILVER HALIDE PHOTOGRAPHIC LIGHT SENSITIVE MATERIAL

[75] Inventor: Tetsuya Suzuki, Hino, Japan

[73] Assignee: Konica Corporation, Japan

[21] Appl. No.: 708,930

[22] Filed: Sep. 6, 1996

[30] Foreign Application Priority Data

Sep. 12, 1995 [JP] Japan ..... 7-234198

[51] Int. Cl.[6] ..... G03C 1/04; G03C 1/035

[52] U.S. Cl. ..... 430/567; 430/569; 430/599; 430/600; 430/601; 430/602

[58] Field of Search ..... 430/567, 569, 430/599, 600, 601, 602

[56] References Cited

U.S. PATENT DOCUMENTS

| | | | |
|---|---|---|---|
| 5,215,879 | 6/1993 | Suzuki et al. | 430/567 |
| 5,275,930 | 1/1994 | Maskasky | 430/567 |
| 5,314,798 | 5/1994 | Brust et al. | 430/567 |
| 5,498,511 | 3/1996 | Yamashita et al. | 430/496 |

OTHER PUBLICATIONS

"Formation and Properties of Sub–Image and Latent–Image Silver Specks—Part II: Properties of Silver Sub–Specks Produced by Chemical Reduction"—E. Palm et al.—The Journal of Photographic Science, vol. 25, 1997—pp. 19 through 27.

European Search Report EP 96 30 6616 with Annex.

*Primary Examiner*—Mark F. Huff

*Attorney, Agent, or Firm*—Jordan B. Bierman; Bierman, Muserlian and Lucas

[57] ABSTRACT

A silver halide photographic light sensitive material comprising a support and provided thereon, at least one silver halide emulsion layer comprising tabular silver halide grains having a silver chloride content of not less than 50 mol % and two parallel major {100} faces and a water soluble polymer other than gelatin, wherein chemical sensitization of the silver halide grains is carried out in the presence of said water soluble polymer.

5 Claims, 1 Drawing Sheet

SILVER HALIDE PHOTOGRAPHIC LIGHT SENSITIVE MATERIAL

FIELD OF THE INVENTION

The present invention relates to a silver halide photographic emulsion (hereinafter referred to as silver halide emulsion), a silver halide photographic light sensitive material (hereinafter referred to as light sensitive material) silver halide emulsion) employing the emulsion and a processing method thereof (hereinafter referred to also as a developing method), and particularly to a silver halide emulsion, a light sensitive material or a developing method thereof giving high sensitivity, an excellent rapid processing performance or improved scratch resistance, safelight safety, silver image tone and processing dependency.

BACKGROUND OF THE INVENTION

When tabular silver halide grains are used in photographic light sensitive material, it is well known that spectral sensitization, covering power, image sharpness or graininess is improved. On the other hand, it is also well known that the tabular silver halide grains have disadvantages in that pressure resistance deterioration, for example, a problem such as blackening due to scratching or bending, is likely to occur probably because of their shape. Recently, tabular silver halide grains having parallel twin planes have been frequently used. These tabular silver halide grains have major {111} faces, and their shape is triangle or hexagonal owing to a {111} face lattice structure.

When a large amount of sensitizing dyes are adsorbed on silver halide grains, grains having a {100} face ordinarily show more excellent spectral sensitization. Therefore, development of grains having a {100} face as a major face has been desired. In U.S. Pat. No. 4,063,951 is disclosed a method of manufacturing a silver halide emulsion comprising tabular grains having an aspect ratio of 1.5 to 7 and having two parallel major {100} faces. In U.S. Pat. No. 4,386,156 are disclosed a silver halide emulsion comprising tabular silver bromide grains having an aspect ratio of not less than 8 and having two parallel major {100} faces and its manufacturing method. It is shown that these emulsions increase contrast and maximum density of a light sensitive material compared to an emulsion comprising cubic silver halide grains having a {100} face.

Demand for rapid processing of a light sensitive material has been strong, and the processing method employing an automatic processor has been prevailed. It is generally known that a silver halide emulsion having a high silver chloride content is preferred in the rapid processing, since silver chloride has higher ionic crystallinity and solubility as compared to silver bromide or silver iodide. However, a silver chloride emulsion is difficult to apply to a light sensitive material for medical use requiring high sensitivity in order to minimize an influence on a human body of radiation ray, since it is low sensitive and is likely to cause fog. In U.S. Pat. No. 5,275,930 is disclosed a technique epitaxial growing tabular grains having a chloride content of not less than 50%, an aspect ratio of not less than 8 and a {100} face as a major face. In U.S. Pat. No. 5,314,798 are disclosed a technique regarding a silver halide emulsion comprising tabular silver iodochloride grains having a chloride content of not less than 50%, an aspect ratio of not less than 2 and a {100} face as a major face and its manufacturing method. However, these emulsions give not only unclear image but yellowish image not pure black, and, when these emulsions are applied to a light sensitive material for medical use in which a silver image is directly observed, the resulting image gives an unpleasant impression to an observer or a diagnostician.

Generally, silver halide emulsion is chemically sensitized for high sensitivity. Reduction sensitization is known as one of chemical sensitizations. However, it is known that this method is likely to cause fog, resulting in fog increase during storage or under safelight. Further, when a silver halide emulsion is subjected to the reduction sensitization together with another sensitization such as gold sensitization or chalcogen sensitization such as sulfur sensitization, the emulsion is highly sensitized but has a problem such as the above described fog occurrence, especially fog occurrence under safelight. It is reported by E. Palm et al., J. Photo Sci., Vol. 25, 19 (1977) that sensitizing nuclei, which are produced by reduction sensitization, are more likely to be formed on a {100} face than a {111} face. Accordingly, it has been difficult in view of fog occurrence or fog occurrence under safelight that tabular tetragonal silver chloride emulsion having a major {100} face is noble metal or chalcogen sensitized together with reduction sensitization to obtain high sensitivity.

SUMMARY OF THE INVENTION

An object of the present invention is to provide a silver halide emulsion and its manufacturing method, a light sensitive material employing the emulsion or a developing method thereof giving high sensitivity, an excellent rapid processing performance or improved scratch resistance, safelight safety, silver image tone and processing dependency.

DETAILED DESCRIPTION OF THE INVENTION

Figure 1:
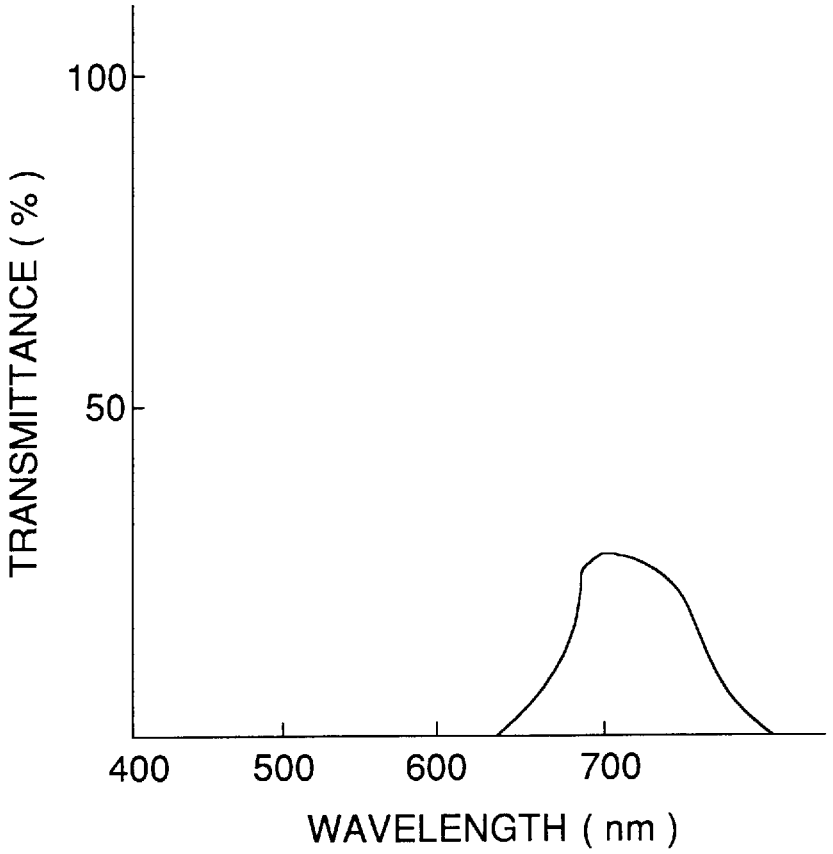
FIG. 1 shows a transmittance curve of a filter.

The above-mentioned object on the invention can be attained the following constitution:

a silver halide emulsion comprising tabular silver halide grains having a silver chloride content of not less than 50 mol % and two parallel major {100} faces, wherein chemical sensitization is carried out in the presence of the water soluble polymer, or a method for processing a silver halide photographic light sensitive material comprising the above silver halide emulsion in a total processing time (Dry to Dry) of not more than 25 seconds.

A water soluble polymer is preferably added to a silver halide emulsion after addition of a reduction sensitizer.

The invention will be detailed below.

In the present invention, the tabular silver halide grains in the emulsion have a major face comprised of a {100} face.

The tabular silver halide grains used in the present invention are grains having an ordinary average grain size, and the average grain size in the invention is preferably 0.3 to 3.0 $\mu$m, and more preferably 0.5 to 2.0 $\mu$m. The average grain size of the tabular silver halide grains referred to in the invention means an average edge length of the major face of the grains.

The edge ratio of the major face (the longest length/the shortest length) is preferably 1.0 to 1.4, and more preferably 1.0 to 1.2.

The average value (referred to as average aspect ratio) of grain edge length /thickness (referred to as aspect ratio) in the tabular silver halide grains of the present invention may be an average aspect ratio used in the ordinary silver halide grains, but is preferably 2.0 or more, more preferably 2.0 to 20.0, and still more preferably 4.0 to 15.0. In order to obtain the average aspect ratio, at least 100 samples are measured.

The average thickness of the tabular silver halide grains of the present invention is an average thickness used in the ordinary tabular silver halide grains, but is preferably 0.5 μm or less, and more preferably 0.3 μm or less.

The major face edge length of the tabular silver halide grains referred to in the invention is defined as an edge length of a square having an area equivalent to a projected area of the grains in the electron microscope photograph of the grains.

The thickness of the silver halide grains referred to in the invention means the minimum distance (that is, a distance between the major faces) of distances between two parallel largest {100} faces.

The thickness of the tabular silver halide grains is obtained from an electron microscope photograph with a shadow such as a carbon replica method of the silver halide grains or from an electron microscope photograph of a section of a sample obtained by coating a silver halide emulsion on a support and drying.

It is essential that the tabular silver halide grains in the invention have a {100} face, but the corner or edge of the grains needs not have a {100} face and may have a {110} or {111} face.

The tabular silver halide emulsion in the invention may have any dispersion properties, but preferably is monodisperse. The monodisperse tabular silver halide emulsion having a different main plane side length, a polydisperse tabular silver halide emulsion having a broad grain size distribution or a normal crystal emulsion comprising a cubic, octahedral or tetradecahedral crystal or a twin plane emulsion comprising silver halide grains having a twin plane may be mixed, as long as the effects of the invention are not inhibited.

It is essential that the silver halide emulsion in the invention have a silver chloride content of not less than 50 mol %, but the emulsion in the invention has a silver chloride content of preferably not less than 65 mol %, more preferably not less than 80 mol %.

The silver halide emulsion of the present invention has a silver chloride content of not less than 50 mol %, but may contain silver iodide. When the silver halide emulsion contains the silver iodide, its content is not more than 2.0 %, preferably not more than 1.5 %, especially preferably not more than 1.0 % or may be 0.

The tabular silver halide emulsion in the present invention may be grains in which the halogen composition is uniform, core/shell grains wherein silver iodide is localized in the central portion or grains having a higher silver iodide content on the surface.

The silver halide emulsion in the invention is manufactured according to a conventional method, and for example, it is possible to refer to U.S. Pat. Nos. 4,063,951, 4,386,156, 5,275,930 and 5,314,798.

Size or shape of the tabular silver halide grains in the invention can be controlled by temperature, pAg (pBr, pCl) or pH during formation of the grains and by addition speed of silver salt and an aqueous halogenated solution. For example, pAg during formation of the grains is preferably 5.0 to 8.0.

In manufacturing tabular silver halide grains, a silver halide solvent such as ammonia, thioether and thiourea can be used.

The silver halide emulsion in the invention may be a surface latent image forming emulsion capable of forming a latent image on the grain surface, an inside latent image forming emulsion capable of forming a latent image inside the grain or an emulsion capable of forming a latent image on the grain surface and inside the grain. An iron, cadmium, lead, zinc, thallium, ruthenium, osmium, iridium, and rhodium salt or their complex may be added to the emulsion during physical ripening or grain formation.

In order to remove a soluble salt from an emulsion (desalting), a water-washing methods such as a noodle water-washing method and a flocculation precipitation method are allowed to be used. As a desirable water-washing method, a method that uses an aromatic hydrocarbon aldehyde resin containing a sulfo group described in Japanese Patent OPI Publication No. 35-16086/1960 is cited. In addition, as a desirable desalting method, a method that uses illustrated coagulation polymers G-3 and G-8 described in Japanese Patent OPI Publication No. 63-158644/1988 is cited. Further, a ultracentrifuge method is preferable.

In the silver halide emulsion in the invention, gelatin is advantageously used as a protective colloid used in the emulsion during its manufacturing or as a binder of another hydrophilic colloid layer, but hydrophilic colloids other than gelatin can be used.

Gelatin includes a lime-processed gelatin, acid-processed gelatin, an oxygen-processed gelatin as described in Bull. Soc. Phot. Japan, No. 16, p.30 (1966), and hydrolyzed or emzyme-decomposed gelatin. In the invention, gelatin having a low methionine content, that is, a methionine content of less than 30 micromol, especially less than 12 micromol based on 1 g of gelatin is preferably used.

In the invention, it is necessary to carry out the chemical sensitization of the silver halide emulsion of the invention in the presence of the water soluble polymer.

The chemical sensitization herein referred is carried out from time when chemical sensitizers is added to a silver halide emulsion till time when a chemical sensitization stopping agent is added to the silver halide emulsion to complete the chemical sensitization.

The addition amount of the water soluble polymer may be basically any amount, but, in the invention, is preferably $1\times10^{-4}$ to $3\times10^{2}$ g/mol of Ag, more preferably $1\times10^{-3}$ to $1\times10^{2}$ g/mol of Ag, and still more preferably $1\times10^{-2}$ to 50 g/mol of Ag.

The solvent of the water soluble polymer can be a hydrophilic organic solvent, but is preferably a mixture solvent of a hydrophilic organic solvent and water and more preferably water.

The water soluble polymer used in the invention may be a synthetic water soluble polymer or a natural water soluble polymer but for gelatin. The preferable water soluble polymer is a polymer having in its molecule a nonionic group, an anionic group, or both of nonionic and anionic groups. The nonionic group includes an ether group, a thioether group, an ethyleneoxide group, a hydroxy group, an amido group, and an imidazolyl group, and the anionic group includes a sulfo group or its salt, a carboxyl group or its salt and a phospho group or its salt.

The water soluble polymer referred to in the invention means a polymer having a water solubility of not less than 0.05 g, preferably not less than 0.1 g based on the 100 g of 20° C. water.

The water soluble polymer includes a synthethic polymer having in its molecule in an amount of 10 to 100 mol % the repeating unit represented by the following Formula (P):

Formula (P)

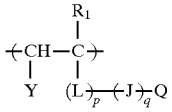

wherein $R_1$ represents a hydrogen atom, an alkyl group, preferably an alkyl group having 1 to 4 carbon atoms which may have a substituent (for example, methyl, ethyl, propyl, butyl), a halogen atom or —$CH_2COOM$ and preferably a hydrogen atom or methyl, L represents —CONH—, —NHCO—, —COO—, —OCO—, —CO—, or —O— and preferably —OCO— or —O—, J represents an alkylene group, preferably an alkylene group having 1 to 10 carbon atoms which may have a substituent (for example, methylene, ethylene, propylene, trimethylene, butylene, hexylene), an arylene group which may have a substituent (for example, phenylene) or —$(CH_2CH_2O)_m(CH_2)_n$— (m represents an integer of 0 to 40, and n represents an integer of 0 to 4), Q represents

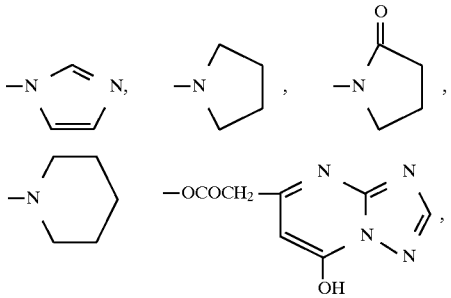

-continued

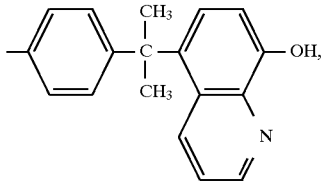

—$N^+(R_4)$ $(R_5)$ $(R_6)X^-$, —$N(R_7)$ $(R_8)$, —OM, —$NH_2$, —$SO_3M$, —O—P(=O) $(OM)_2$, —C(=O)$R_2$, a hydrogen atom or $R_3$ described later.

Of these, —$SO_3M$, —O—P(=O) $(OM)_2$ and —C(=O) $R_2$ are preferable, and —$SO_3M$ is most preferable. $R_2$ represents an alkyl group having 1 to 4 carbon atoms which may have a substituent (for example, methyl, ethyl, propyl, butyl), $R_3$, $R_4$, $R_5$, $R_6$, $R_7$ and $R_8$ independently represent an alkyl group having 1 to 20 carbon atoms which may have a substituent (for example, methyl, ethyl, propyl, butyl, hexyl, decyl, hexadecyl), the substituent including an alkoxy group having 1 to 10 carbon atoms or an alkoxy group containing a thioether group having 1 to 10 carbon atoms, X represents an anion, Y represents a hydrogen atom or a carboxy group, and p and q independently represent 0 or 1.

The water soluble polymer used in the invention is especially preferably a polymer having in its molecule a nonionic group. Such a polymer includes a polyvinyl alcohol, a polyvinyl pyrrolidone, a polyvinyl imidazole, a polyacrylamide, and a polymer having a hydroxyquinoline or a thioether group. Of these, a polyvinyl alcohol, a polyvinyl pyrrolidone and a a polyacrylic acid are preferable.

The exemplified compound of the water soluble polymer represented by Formula (P) will be shown below.

| | | Number average molecular weight Mn |
|---|---|---|
| SP-1 | $(CH_2-CH)_{100}$ OH | 8,000 |
| SP-2 | $(CH_2-CH)_{100}$ $NH_2$ | 6,200 |
| SP-3 | $(CH_2-CH)_{100}$ COOH | 4,800 |
| SP-4 | $(CH_2-CH)_{100}$ N 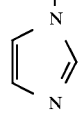 | 4,700 |
| SP-5 | $(CH_2-CH)_{100}$ N 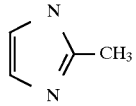 | 6,000 |
| SP-6 | $(CH_2-CH)_{100}$ N 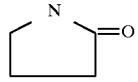 | 2,500 |

-continued

| | | |
|---|---|---|
| SP-7 | $(CH_2-CH)_{100}$ <br> $CH_2NH_2$ | 11,000 |
| SP-8 | $(CH_2-CH)_{100}$ <br> $CONH_2$ | 15,000 |
| SP-9 | $CH_3$ <br> $(CH_2-CH)_{100}$ <br> $COOCH_2CH_2SO_3Na$ | 4,800 |
| SP-10 | $(CH_2-CH)_{100}$ <br> $SO_3Na$ | 7,800 |
| SP-11 | $CH_3$ <br> $(CH_2-C)_{100}$ <br> $COO(CH_2CH_2O)_4H$ | 9,000 |
| SP-12 | $(CH_2-CH)_{100}$ <br> $COOCH_2CH_2OP(=O)(ONa)-ONa$ | 3,200 |
| SP-13 | $(CH_2-CH)_{100}$ $CH_3$ <br> $CONH-C(CH_3)-CH_2SO_3Na$ | 9,800 |
| SP-14 | $(CH_2-CH)_{100}$ $CH_3$ <br> $CONH-C(CH_3)-CH_2SO_3Na$ | 6,200 |
| SP-15 | $(CH_2-CH)_{100}$ <br> $OCOCH_3$ | 4,000 |
| SP-16 | $(CH_2-CH)_{100}$ <br> $CO-N$ | 9,500 |
| SP-17 | $CH_3$ <br> $(CH_2-C)_{100}$ $C_2H_5$ <br> $COOCH_2CH_2N^+-C_4H_9$ <br> $C_2H_5$ $Cl^-$ | 8,200 |
| SP-18 | $CH_3$ <br> $(CH_2-C)_{100}$ <br> $COOCH_2CH_2N(C_2H_5)_2$ | 11,000 |
| SP-19 | $(CH_2-CH)_{100}$ <br> $COOCH_2CH_2CH_2SO_3K$ | 4,300 |
| SP-20 | $(CH_2-CH)_{50}$ $(CH_2-CH)_{50}$ <br> $OH$ $OCOCH_3$ | 9,000 |

-continued

| | | |
|---|---|---|
| SP-21 | $(CH_2-CH)_{80}$ (OH) $(CH_2-CH)_{20}$ ($OCOCH_3$) | 9,000 |
| SP-22 | $(CH_2-CH)_{50}$ (C6H5) $(CH_2-CH)_{50}$ (COOH) | 2,600 |
| SP-23 | $(CH_2-CH)_{50}$ ($COOC_2H_5$) $(CH_2-CH)_{50}$ (COOH) | 11,000 |
| SP-24 | $(CH_2-CH)_{80}$ (N, N) $(CH_2-CH)_{20}$ ($COOC_4H_9$) | 63,000 |
| SP-25 | $(CH_2-CH)_{5}$ (C6H5) $(CH_2-CH)_{95}$ ($CONH_2$) | 5,300 |
| SP-26 | $(CH_2-CH)_{95}$ ($OCOCH_3$) $(CH_2-CH)_{5}$ (N, N) | 12,000 |
| SP-27 | $(CH_2-CH)_{80}$ ($CONHC(CH_3)_2CH_2SO_3Na$) $(CH_2-CH)_{20}$ ($COOC_4H_9$) | 6,800 |
| SP-28 | $(CH-CH)_{95}$ (COOH, COOH) $(CH_2-C(CH_3))_{5}$ ($COOCH_2CH_2SO_3K$) | 2,800 |
| SP-29 | $(CH-CH)_{95}$ (O=C, C=O, O) $(CH-CH)_{5}$ (COONa, COONa) | 2,600 |
| SP-30 | $(CH_2-CH)_{20}$ ($COOC_4H_9$) $(CH_2-C(CH_3))_{80}$ ($COO(CH_2CH_2O)_{10}C_4H_9(t)$) | 33,000 |
| SP-31 | $(CH_2-CH)_{50}$ ($OCOC_2H_5$) $(CH_2-CH)_{50}$ ($COOCH_2CH_2OP(=O)(ONa)ONa$) | 2,100 |
| SP-32 | $(CH_2-C(CH_3))_{40}$ ($COOC_2H_4SO_3K$) $(CH_2-CH)_{60}$ ($CONHC(CH_3)_2CH_2SO_3Na$) | 163,000 |

-continued

| | | |
|---|---|---|
| SP-33 | $(CH_2-CH)_{40}$ (COOCH$_2$CH$_2$OH) $(CH_2-CH)_{60}$ (CONHC(CH$_3$)$_2$CH$_2$SO$_3$Na) | 8,000 |
| SP-34 | $(CH_2-C(CH_3))_{60}$ (COO(CH$_2$CH$_2$O)$_4$H) $(CH_2-CH)_{40}$ (COOCH$_2$CH$_2$OP(=O)(ONa)$_2$) | 4,700 |
| SP-35 | $(CH_2-C(CH_3))_{70}$ (COO(CH$_2$CH$_2$O)$_{10}$C$_4$H$_9$(t)) $(CH_2-CH)_{30}$ (COOH) | 5,500 |
| SP-36 | $(CH_2-C(CH_3))_{50}$ (COOCH$_2$CH$_2$OH) $(CH_2-C(CH_3))_{50}$ (COOCH$_2$CH$_2$SO$_3$Na) | 11,000 |
| SP-37 | $(CH_2-CH)_{30}$ (OH) $(CH_2-CH)_{70}$ (CONHC(CH$_3$)$_2$CH$_2$SO$_3$Na) | 3,200 |

$(CH_2-C(CH_3))_m$ (COOCH$_2$CH$_2$OH) $(A)_n$

| | m | n | (A) | Number average molecular weight (Mn) |
|---|---|---|---|---|
| SP-38 | 50 | 50 | $(CH_2-CH)$ (COOH) | 7,300 |
| SP-39 | 40 | 60 | $(CH_2-C(CH_3))$ (COOH) | 2,700 |
| SP-40 | 60 | 40 | $(CH_2-C(CH_3))$ (COOCH$_2$CH$_2$SO$_3$Na) | 4,800 |
| SP-41 | 50 | 50 | $(CH_2-CH)$ ($C_6H_4$-SO$_3$Na) | 11,500 |
| SP-42 | 40 | 60 | $(CH_2-CH)$ (COOCH$_2$CH$_2$OP(=O)(ONa)$_2$) | 8,700 |
| SP-43 | 40 | 60 | $(CH_2-CH)$ (CONHC(CH$_3$)$_2$CH$_2$SO$_3$Na) | 5,300 |
| SP-44 | 50 | 50 | $(CH_2-CH)$ (CONHC(CH$_3$)($C_6H_5$)CH$_2$SO$_3$Na) | 7,900 |

-continued

| | | | | |
|---|---|---|---|---|
| SP-45 | 50 | 50 | $\leftarrow CH_2-CH \rightarrow$ (COOCH$_2$CH$_2$SO$_3$Na) | 4,900 |
| SP-46 | 50 | 50 | $\leftarrow CH-CH \rightarrow$ (COOH, COOH) | 2,800 |
| SP-47 | $\leftarrow CH_2-C(CH_3) \rightarrow_{50}$ (COO(CH$_2$CH$_2$O)$_4$H) | | $-CH_2-C(CH_3) \rightarrow_{50}$ (COOCH$_2$CH$_2$SO$_3$Na) | 6,300 |
| SP-48 | $\leftarrow CH_2-C(CH_3) \rightarrow_{50}$ (COO(CH$_2$CH$_2$O)$_4$H) | | $\leftarrow CH_2-CH \rightarrow_{50}$ (SO$_3$Na) | 10,500 |
| SP-49 | $\leftarrow CH_2-C(CH_3) \rightarrow_{50}$ (COO(CH$_2$CH$_2$O)$_8$H) | | $\leftarrow CH_2-CH \rightarrow_{50}$ (SO$_3$Na) | 7,200 |
| SP-50 | $\leftarrow CH_2-C(CH_3) \rightarrow_{40}$ (COOCH$_2$CH$_2$OH) | | $\leftarrow CH_2-CH \rightarrow_{30}$ (SO$_3$Na) $\leftarrow CH_2-CH \rightarrow_{30}$ (COOC$_4$H$_9$) | 14,300 |
| SP-51 | $\leftarrow CH_2-C(CH_3) \rightarrow_{10}$ (COOCH$_2$CH$_2$OH) | | $\leftarrow CH_2-CH \rightarrow_{20}$ (COOCH$_2$CH$_2$SO$_3$Na) $\leftarrow CH_2-CH \rightarrow_{70}$ (COOCH$_3$) | 15,600 |
| SP-52 | $\leftarrow CH_2-CH \rightarrow_{98}$ (OH) | | $\leftarrow CH_2-CH \rightarrow_{2}$ (OCOCH$_3$) | 22,000 |
| SP-53 | $\leftarrow CH_2-CH \rightarrow_{88}$ (OH) | | $\leftarrow CH_2-CH \rightarrow_{12}$ (OCOCH$_3$) | 25,000 |
| SP-54 | $\leftarrow CH_2-CH \rightarrow_{98}$ (OH) | | $\leftarrow CH_2-CH \rightarrow_{2}$ (OCOCH$_3$) | 45,000 |
| SP-55 | $\leftarrow CH_2-CH \rightarrow_{88}$ (OH) | | $\leftarrow CH_2-CH \rightarrow_{12}$ (OCOCH$_3$) | 49,000 |
| SP-56 | $\leftarrow CH_2-CH \rightarrow_{98}$ (OH) | | $\leftarrow CH_2-CH \rightarrow_{2}$ (OCOCH$_3$) | 76,000 |
| SP-57 | $\leftarrow CH_2-CH \rightarrow_{88}$ (OH) | | $\leftarrow CH_2-CH \rightarrow_{12}$ (OCOCH$_3$) | 83,000 |
| SP-58 | $\leftarrow CH_2-CH \rightarrow_{98}$ (OH) | | $\leftarrow CH_2-CH \rightarrow_{2}$ (OCOCH$_3$) | 108,000 |
| SP-59 | $\leftarrow CH_2-CH \rightarrow_{88}$ (OH) | | $\leftarrow CH_2-CH \rightarrow_{12}$ (OCOCH$_3$) | 118,000 |

-continued

| | | | |
|---|---|---|---|
| SP-60 | | $(CH_2-CH)_{100}$ N O | 10,000 |
| SP-56 | | $(CH_2-CH)_{100}$ N O | 40,000 |
| SP-62 | | $(CH_2-CH)_{100}$ N O | 100,000 |
| SP-63 | $(CH_2-CH)_{35}$ OH | $(CH_2-CH)_{75}$ N O | 60,000 |
| SP-64 | $(CH_2-CH)_{95}$ $CONH_2$ | $(CH_2-CH)_{5}$ N O N | 55,000 |

The synthetic water soluble polymer in the invention can be easily synthesized according to various solution, bulk or suspension polymerization methods.

For example, in the solution polymerization, a mixture of monomers having an appropriate concentration (ordinarily not more than 40 wt %, preferably 10 to 25 wt % based on the solvent) in a solvent (such as ethanol, methanol or water) is heated to an appropriate temperature (for example, 40°–120° C., preferably 50°–100° C.) in the presence of a polymerization initiator (for example, benzoylperoxide, azobisisobutylonitrile or ammonium persulfate) and copolymerised. The resulting reaction mixture is poured into a solvent to obtain precipitates. The precipitates were dried to remove unpolymerized mixture. Thus, a synthetic water soluble polymer was obtained.

The average molecular weight of the synthetic water soluble polymer in the invention is 1,000 to 1,000,000, preferably 2,000 to 500,000. The average molecular weight is obtained in terms of standard polystyrene by measuring through gel permeation chromatography HLC-802A produced by Toyo Soda Co., Ltd.

The water soluble polymer in the invention includes lignin, starch, pullulan, cellulose, alginic acid, dextran, dextrin, guar gum, gum arabic, glycogen, laminarin, lichenin, nigeran and its derivatives detailed in "Suiyouseikoubunshi mizubunsangatajusi no sogogijutsushiryoshu" (published by Keiei kaihatsu center shuppanbu). The natural water soluble polymer derivative in the invention includes the above water soluble polymer sulfonated, carboxylated, phosphorylated, sulfoalkylated, carboxyakylated or alkyl phosphorylated and their salts.

Of the natural water soluble polymers, a glucose polymer or its derivatives is preferable, and, of the glucose polymer or its derivatives, starch, glycogen, cellulose, lichenin, dextran, nigeran is more preferable, and dextran or its derivatives are especially preferable.

The natural water soluble polymers may be used in combination.

In the invention, as described above, the water soluble polymer is preferably added in the polymer solution form to an emulsion. It is preferable that a chemical sensitizer is added in the presence of the water soluble polymer.

Another chemical sensitizer will be explained below.

The silver halide emulsion in the invention is preferably sensitized at pH 4.0 or more with noble metal and chalcogen sensitizers. It is preferable in the invention that the noble metal and/or chalcogen sensitizations are carried out in the presence of the water soluble polymer.

The preferable pH range is 4.5 to 10.0, and the more preferable pH range is 5.0 to 9.0.

In the noble metal sensitizer, gold sensitization is preferable, and a gold compound, a gold complex such as a gold thiocyanate complex is used. The complex other than gold complex includes a complex of platinum, iridium, osmium, palladium, rhodium or ruthenium.

A gold sensitizer used for the gold sensitization includes, for example, chloroaurate salt, gold thiourea salt, potassium chloroaurate, auric trichloride, potassium auric thiocyanate, potassium iodoaurate, tetracyanoauric amide, ammonium aurothiocyanate and pyridyl trichloro gold. The added amount of the above-mentioned gold sensitizers can be changed widely depending upon various conditions. As a target, $5\times10^{-8}$ to $5\times10^{-3}$ mol per mol of silver halide is preferred and $1\times10^{-7}$ to $4\times10^{-4}$ mol is more preferred.

The sensitizer used in the sulfur sensitization includes, for example, thiosulfate, alylthiocarbamido thiourea, allylisothiacyanate, systin, p-toluenethiosulfonic acid salt and rhodanine. The addition amount of the sulfur sensitizer that is just sufficient to enhance the sensitivity of an emulsion effectively is acceptable. This amount can be changed widely depending upon various conditions such as the size of silver halide grains. As a target, the addition amount is preferably $5\times10^{-8}$ to $5\times10^{-5}$ mol per mol of silver, and more preferably $1\times10^{-7}$ to $1\times10^{-4}$ mol per mol of silver.

The selenium and/or tellurium sensitization is preferably carried in combination. The selenium sensitization is usually carried out by adding an unstable type selenium compound and/or a non-unstable type selenium compound to a silver halide emulsion and the emulsion is then stirred at a high temperature, preferably, a temperature of not lower than 40° C. for a specific time.

The typical unstable type selenium sensitizers include, for example, an isoselenocyanate (for example, an aliphatic isoselenocyanate such as allylisoselenocyanate), a selenourea, a selenoketone, a selenoamide, a selenocarboxylic acid (for example, 2-selenopropionic acid or 2-selenobutyric acid), an selenoester, a diacylselenide (for example, bis-3-chloro-2,6-dimethoxybenzoylselenide), a selenophosphate, phosphinselenide and collid metal selenium. The preferable unstable type selenium compound will be given below. The preferable pattern of an unstable type selenium compounds are stated above. However, the present invention is not limited thereto. To those skilled in the art, the structure of unstable selenium compound as a sensitizer for the photographic emulsion is not so important provided that selenium is unstable. It is commonly understood that the organic portion of the selenium sensitizer molecule does not have any role except for carrying selenium and letting it exist in the emulsion in an unstable form.

In the present invention, unstable selenium compound having the above-mentioned wide concept is advantageously used. The non-unstable type selenium compound include, for example, selenous acid, potassium selenocyanide, a selenazole, a quaternary salt of a selenazole, a diaryl selenide, a diaryl diselenide, a dialkyl selenide, a dialkyl diselenide, 2-thioselenazolidinedione, 2-selenoxazolidinethione and derivatives thereof.

The addition amount of the selenium sensitizer depends upon kinds of selenium compounds used, kinds of silver halide grains used or chemical ripening conditions, but is preferably not less than $1\times10^{-8}$ mol per mol of silver halide. It is more preferable that the selenium sensitizer is added in an amount of $1\times10^{-7}$ to $1\times10^{-4}$ mol per mol of silver halide during chemical sensitization. The selenium sensitizer is added with a solution in which the selenium compound is dissolved in water or an organic solvent such as methanol or ethanol or its mixture solvent depending on nature of the selenium compound, a gelatin solution containing the selenium compound or a dispersion solution containing an organic solvent soluble polymer and the selenium compound as disclosed in Japanese Patent O.P.I. Publication Nos. 4-140739/1992.

Next, the tellurium sensitizer preferably used for chemical sensitization in the invention and its sensitizing method will be explained.

The typical tellurium sensitizer includes colloid tellurium, telluroureas (for example, allyltellurourea, N,N-dimethyltellurourea, tetramethyltellurourea, N-carboxyethyl-N,N'-dimethyltellurourea, N,N'-dimethylethylenetellurourea, N,N'-diphenylethylenetellurourea), isotellurocyanates (for example, allylisotellurocyanate), telluroketones (for example, telluroacetone, telluroacetophenone), telluroamides (for example, telluroacetoamide, N,N-dimethyltellurobenzamide), tellurohydrazides (for example, N,N',N'-trimethyltellurobenzhydrazide), telluroesters (for example, t-butyl-t-hexyltelluroester), phosphintellurides (tributylphosphintelluride, tricyclohexylphosphintelluride, triisopropylphosphintelluride, butyl-diisopropylphosphintelluride, dibutylphenylphosphintelluride) and another tellurium compound (for example, gelatin containing a negative charging tellurium ion, potassium telluride, potassium tellurocyanate, telluropentathionate sodium salt and allyltellurocyanate disclosed in British Patent No. 1,295,462).

The addition amount of the tellurium sensitizer depends upon kinds of silver halide grains used or chemical ripening conditions, but is preferably $10^{-8}$ to $10^{-2}$ Mol per mol of silver halide, and more preferably $10^{-7}$ to $5\times10^{-3}$ mol per mol of silver halide. The chemical sensitization is not specifically limited, but pAg is preferably 6–11, more preferably 7–10 and temperature is preferably 40°–90° C., and more preferably 45°–85° C.

In the invention, noble metal and/or chalcogen sensitization is preferably carried out together with reduction sensitization.

The reduction sensitization in the invention can be selected from a method of adding a reduction sensitizer to an emulsion, a method of growing or ripening an emulsion under a lower pAg such as pAg 1 to 7, which is called silver ripening, and a method of growing or ripening an emulsion under a higher pH such as pH 8 to 11, which is called high pH ripening. Of these methods, the reduction sensitizer addition method is preferable in order to finely adjust reduction sensitization level.

Stannous salts, amines or polyamines, hydrazine derivatives, formamidinesulfinic acid, a silane compound or a borane compound are known as a reduction sensitizer. The reduction sensitization in the invention can be carried out using these reduction sensitizers, and two or more kinds of reduction sensitizers can be used. Stannous chloride, thiourea dioxide and dimethylamine borane are preferable as reduction sensitizers. The addition amount of these reduction sensitizers depends upon emulsion manufacturing conditions, but is suitably $10^{-8}$ to $10^{-3}$ mol per mol of silver halide.

These reduction sensitizers are added in a solution in which the sensitizers are dissolved in solvents such as alcohols, glycols, ketones, esters or amides.

It is especially preferable that the water soluble polymer is added after addition of a reduction sensitizer. The "after addition of a reduction sensitizer" herein referred to comprises the simultaneous addition of the reduction sensitizer and synthetic water soluble polymer.

When another sensitizer is used together with the reduction sensitizer, it is preferable that the chemical sensitizer is added before addition of the water soluble polymer.

The reduction sensitization in the invention is especially preferably carried out by addition of ascorbic acid or its derivatives. The typical example of the ascorbic acid or its derivatives (hereinafter referred to as an ascorbic acid compound) includes the following compounds.

(A-1) L-ascorbic acid
(A-2) Sodium L-ascorbate
(A-3) Potassium L-ascorbate
(A-4) DL-ascorbic acid
(A-5) Sodium DL-ascorbate
(A-6) L-ascorbic acid-6-acetate
(A-7) L-ascorbic acid-6-palmitate
(A-8) L-ascorbic acid-6-benzoate
(A-9) L-ascorbic acid-6-diacetate
(A-10) L-ascorbic acid-5,6-O-isopropylidene In order to add the ascorbic acid compound to the silver halide emulsion in the invention, the compound may be added, directly or in a solution in which the compound is dissolved in water, methanol, ethanol or a mixture thereof, to the emulsion.

The ascorbic acid compound used in the invention is preferably added in an amount larger than another conventional reduction sensitizer. There is, for example, description in Japanese Patent Publication No. 57-33572/1982 that the addition amount of a reduction sensitizer does not exceed $0.75\times10^{-2}$ milliequivalent per g of a silver ion ($8\times10^{-4}$ mol/AgX mol), and is effectively 0.1 to 10 mg per 1 kg of silver nitrate (equivalent to $10^{-7}$ to $10^{-5}$ mol/AgX of ascorbic acid). There is description in U.S. Pat. No. 2,487,850 that the addition amount of a stannous compound as a reduction sensitizer $1\times10^{-7}$ to $44\times10^{-6}$ mol. There is description in Japanese Patent O.P.I. Publication No. 57-179835/1982 that that the addition amount of thiourea dioxide is suitably 0.01 to about 2 mg per mol of silver halide and the addition amount of stannous chloride is suitably 0.01 to about 3 mg per mol of silver halide. The addition amount of the ascorbic acid compound depends on grain size, a halogen composition of the grains or temperature, pH or pAg during the emulsion preparation, but is preferably $5\times10^{-5}$ to $1\times10^{-1}$ mol per mol of silver halide, more preferably $5\times10^{-4}$ to $1\times10^{-2}$ mol per mol of silver halide, and still more preferably $1\times10^{-5}$ to $1\times10^{-2}$ mol per mol of silver halide.

In the invention, the ascorbic acid compound sensitization can be carried out together with another reduction sensitization.

The silver halide emulsion in the invention can be spectrally sensitized.

The spectral sensitizing dye is preferably a methine dye, and includes cyanine dyes, merocyanine dyes, complex cyanine dyes, complex merocyanine dyes, holopolar cyanine dyes, hemicyanine dyes, styryl dyes and hemioxonol dyes.

The example thereof includes oxacarbocyanines, benzoimidazolocarbocyanines and benzoimidazolooxacarbocyanines disclosed in Japanese Patent O.P.I. Publication Nos. 5-113619/1993, and dyes having a sensitization effect in the blue light range disclosed in Japanese Patent O.P.I. Publication Nos. 6-332102/1994. These spectral sensitizing dyes may be used singly or in combination.

The spectral sensitizing dye addition is preferably carried out using as a solution in which the dye is dissolved in an organic solvent such as methanol or as a solid dispersion.

The spectral sensitizing dye addition amount depends on kinds of dyes or emulsion conditions, but is preferably 10–900 mg, more preferably 60–400 mg per mol of silver.

The spectral sensitizing dye is preferably added or may be added in separate several times, before completion of chemical sensitization. The spectral sensitizing dye is added more preferably at a period from completion of grain growth to completion of chemical sensitization, and especially preferably before beginning of chemical sensitization.

In order to stop chemical sensitization (chemical ripening) in the invention, a chemical sensitization stopping agent is preferably used in view of emulsion stability. The chemical sensitization stopping agent includes a halide such as potassium bromide or sodium chloride, an anti-foggant and an organic compound well known as a stabilizer (for example, 4-hydroxy-6-methyl-1,3,3a,7-tetraazaindene). These may be used singly or in combination.

To the emulsion used in the present invention, various photographic additives can be added during a physical ripening step or before or after a chemical ripening step. As conventional additives, for example, compounds described in Research Disclosure Nos. 17643, 18716 (November, 1979) and 308119 (December, 1989) are cited. Kind of compound and place described in these three RDs are illustrated as follows:

| | RD-17643 | | RD-18716 | | RD-308119 | |
|---|---|---|---|---|---|---|
| Additive | Page | Classification | Page | Classification | Page | Classification |
| Chemical sensitizer | 23 | III | 648 upper right | | 996 | III |
| Sensitizing dye | 23 | IV | 648–649 | | 996–8 | IVA |
| Desensitizing dye | 23 | IV | | | 998 | IVB |
| Pigment | 25–26 | VIII | 649–650 | | 1003 | VIII |
| Development accelerator | 29 | XIII | 648 upper right | | | |
| Anti-foggant and stabilizer | 24 | IV | 649 upper right | | 1006–7 | VI |
| Brightening agent | 24 | V | | | 998 | V |
| Hardener | 26 | X | 651 left | | 1004–5 | X |
| Surfactant | 26–7 | XI | 650 right | | 1005–6 | XI |
| Anti-static agent | 27 | XII | 650 right | | 1006–7 | XIII |
| Plasticizer | 27 | XII | 650 right | | 1006 | XII |
| Lubricant | 27 | XII | | | | |
| Matting agent | 28 | XVI | 650 right | | 1008–9 | XVI |
| Binder | 26 | XXII | | | 1003–4 | IX |
| Support | 28 | XVII | | | 1009 | XVII |

As a support capable of being used in the light-sensitive material of the present invention, those described in the above-mentioned RD-17643, page 28 and RD-308119, page 1009 are cited.

As a suitable support, a plastic film is cited. On the surface of such a support, a subbing layer, corona discharge for UV irradiation may be provided for the better adhesion of coating layer.

EXAMPLES

The invention will be detailed according to the following examples, but it is not limited thereto.

Example 1

(Preparation of Seed emulsion A)

Seed emulsion A was prepared using the following solutions.

| | |
|---|---|
| A1 | |
| Ossein gelatin | 100 g |
| Potassium bromide | 2.05 g |
| Water was added to make 11.5 liter. | |
| B1 | |
| Ossein gelatin | 55 g |
| Potassium bromide | 65 g |
| Potassium iodide | 1.8 g |
| 0.2 N sulfuric acid | 38.5 ml |
| Water was added to make 2.6 liter. | |
| C1 | |
| Ossein gelatin | 75 g |
| Potassium bromide | 950 g |
| Potassium iodide | 27 g |
| Water was added to make 3.0 liter. | |

-continued

| | |
|---|---|
| D1 | |
| Silver nitrate | 95 g |
| Water was added to make 2.7 liter. | |
| E1 | |
| Silver nitrate | 1410 g |
| Water was added to make 3.2 liter. | |

Solution B1 and Solution D1 were added to Solution A1 in 100 minutes at 60° C. by a controlled double-jet method. Thereafter, Solution C1 and Solution E1 were further added in 105 minutes by a controlled double-jet method. The stirring speed was 500 rpm.

During this process, the addition of solutions was carried out at an appropriate addition rate not to produce a new nucleus during grain formation and not to cause polydispersion due to Ostwald ripening. In adding a silver or halide ion, pAg is adjusted to 8.3±0.05 with a potassium bromide solution and pH is adjusted to 2.0±0.1 with a sulfuric acid solution.

After the addition, pH was regulated to 6, and then the emulsion was subjected to desalting as described in Japanese Patent Publication No. 35-16086/1960 and cooled to set.

It was observed by an electron microscope that this seed emulsion was composed of tetradecylhedral cubic grains having an average grain size of 0.27 μm and a grain size distribution broadness of 17%, which corner was slightly broken.

(Preparation of silver iodide fine grains)

1500 ml of each of a 1.06 mol silver nitrate solution and a 1.06 mol potassium iodide solution were added to 5000 ml of a 5.2 weight % gelatin solution containing 0.008 mol of potassium iodide in 30 minuets. During the preparation of the fine grains, temperature was kept at 40° C. It was observed by an electron microscope in a magnification rate of 600 that this silver iodide fine grains had an average grain size of 0.045 μm.

(Preparation of EM-1)

Comparative emulsion EM-1 was prepared using Seed emulsion A and the seven following solutions.

| | |
|---|---|
| A2 | |
| Ossein gelatin | 42.7 g |
| $H—(CH_2CH_2O)_m—[CH(CH_3)—CH_2O]_{17}—(CH_2CH_2O)_n—H$ (m + n = 5–7, molecular weight 1700) (10% methanol solution) | 9 ml |
| 28% Ammonia water | 370 ml |
| 56% Acetic acid solution | 530 ml |
| Seed emulsion A | in terms of 0.417 mol of silver |
| Water was added to make 4200 ml. | |
| B2 | |
| Ossein gelatin | 23.3 g |
| Potassium bromide | 2357 g |
| Water was added to make 4660 ml. | |
| C2 | |
| Silver nitrate | 3510 g |
| 28% Ammonia water | 2880 ml |
| Water was added to make 5940 ml. | |
| D2 | |
| Silver iodide fine grain emulsion | in terms of 0.199 mol silver. |

-continued

| | |
|---|---|
| E2 | |
| 3.5N Potassium bromide solution | |
| F2 | |
| 56% Acetic acid solution | |

Solutions B2, C2 and D2 were added to Solution A2 at 75° C. in 115 minutes with vigorous stirring.

Herein, the addition rate of solutions B2 and C2 was varied as a function of time to meet a critical grain growing rate. That is, the addition was carried out at an appropriate addition rate not to produce small grains other than the seed grains and not to cause polydispersion due to Ostwald ripening. The addition of D2 solution, silver iodide fine grain emulsion was carried out at an addition rate relative to C2 of 0.3, which was varied to the grain size (addition time), and was completed at 3% addition of the total C2.

The pAg was kept 7.3 with E2 and F2 before 4.37N potassium bromide solution was added, and pH was kept 7.

After the addition, in order to remove excess salts, a Demol (produced by Kao Atlas Co., Ltd.) solution and a magnesium sulfate solution were added and the resulting precipitates were washed and redispersed at 50° C. for 30 minutes in gelatin and cooled to set. Thus, Emulsion EM-1 of pAg 8.5 and pH 5.85 was obtained It was observed by a scanning electron microscope that the resulting emulsion had monodisperse cubic core/shell type silver halide grains having an average iodide content of 1 mol %, an average grain size of 0.98 μm and a grain size distribution broadness of 18%.

(Preparation of EM-2)

This example was prepared as a light sensitive material used for a medical light sensitive material for X ray. EM-2 was prepared employing the following solutions A3 through F3.

| | |
|---|---|
| [A3] | |
| Oxidized gelatin | 350.0 g |
| Sodium chloride | 3.27 g |
| Potassium iodide | 0.25 g |
| Water is added to make 10.0 liter. | |
| [B3] | |
| Silver nitrate | 51.0 g |
| Water is added to make 150 ml. | |
| [C3] | |
| Sodium chloride | 17.45 g |
| Water is added to make 150 ml. | |
| [D3] | |
| Potassium iodide | 0.25 g |
| Water is added to make 150 ml. | |
| [E3] | |
| Silver nitrate | 794.5 g |
| Water is added to make 9.4 liter. | |
| [F3] | |
| Sodium chloride | 286.4 g |
| Potassium iodide | 3.63 g |
| Water is added to make 10.0 liter. | |

Solution B3, C3 and D3 were added to Solution A3 in a reaction vessel in 30 seconds at 40° C. while vigorously stirring by a triple-jet method. Thereafter, the reaction mixture was stirred at 40° C. for 40 minutes, and Solutions E3 and F3 were added in 40 minutes at an addition speed of 40 ml/minute, and then in about 100 minutes at an addition speed of 80 ml/minute by a double-jet method. During the addition, pCl of the reaction solution was kept 2.30 and pH was constantly 5.8. One hundred grams of phthalated gelatin were added and stirred, and in order to remove excess salts, a Demol (produced by Kao atlas Co., Ltd.) solution and a magnesium sulfate solution was added to obtain precipitates in the same manner as EM-1. The resulting precipitates were washed with water, added with an additional gelatin, stirred at 50° C. for 30 minutes and cooled to set.

It was observed by an electron microscope that this emulsion had tabular silver halide grains having a major face average edge length (an average grain size) of 1.58 μm, an average thickness of 0.12 μm, an average aspect ratio of 7.8 and a grain size variation coefficient of 27%, 89% of the grains having a square or rectangle as a major face {100}. Thus, Emulsion EM-2 was obtained.

(Preparation of EM-3)

EM-3 was prepared employing the following solutions A4 through G4.

| | |
|---|---|
| [A4] | |
| Oxidized gelatin | 350.0 g |
| Sodium chloride | 3.27 g |
| Potassium iodide | 0.25 g |
| Water is added to make 10.0 liter. | |
| [B4] | |
| Silver nitrate | 51.0 g |
| Water is added to make 150 ml. | |
| [C4] | |
| Sodium chloride | 17.45 g |
| Water is added to make 150 ml. | |
| [D4] | |
| Potassium iodide | 0.25 g |
| Water is added to make 150 ml. | |
| [E4] | |
| Silver nitrate | 794.5 g |
| Water is added to make 9.4 liter. | |
| [F4] | |
| Sodium chloride | 283.7 g |
| Water is added to make 10.0 liter. | |
| [G4] | |
| Silver iodide fine grain emulsion | in terms of $4.59 \times 10^2$ mol silver |
| Water is added to make 1000 ml. | |

Solution B4, C4 and D4 were added to Solution A4 in a reaction vessel in 30 seconds at 40° C. while vigorously stirring by a triple-jet method. Thereafter, the reaction mixture was stirred at 40° C. for 12 minutes.

Subsequently, over 40 minutes, Solutions E4 and F4 were added at an addition speed of 40 ml/minute and Solution G4 at an addition speed of 4 ml/minute by a double-jet method, and then, over about 100 minutes, Solutions E4 and F4 at an addition speed of 80 ml/minute and Solution G4 at an addition speed of 8 ml/minute by a double-jet method. During the addition, pCl of the reaction solution was kept 2.30 and pH was constantly 5.8. One hundred grams of phthalated gelatin were added, stirred and desalted in the same manner as in EM-1. in order to remove excess salts. The resulting precipitates were added with an additional gelatin, stirred at 50° C. for 30 minutes and cooled to set. It was observed by an electron microscope that this emulsion had tabular silver halide grains having an average grain size of 1.38 μm, an average thickness of 0.15 μm, an average aspect ratio of 9.2, 94% of the grains having a square or rectangle as a major face {100}. Thus, Emulsion EM-3 having an average iodide content of 1 mol % was obtained.

(Preparation of hexahedral tabular seed emulsion B)

A hexahedral tabular seed emulsion was prepared by the following method.

| | |
|---|---|
| [A-5] | |
| Ossein gelatin | 60.2 g |
| $H—(CH_2CH_2O)_m—[CH(CH_3)—CH_2O]_{17}-(CH_2CH_2O)_n—H$ (m + n = 5–7) (10% methanol solution) | 5.6 ml |
| KBr | 26.8 g |
| 10% $H_2SO_4$ | 144 ml |
| Distilled water | 20.0 liter |
| [B-5] | |
| $AgNO_3$ | 1487 g |
| Distilled water was added to make 3500 ml. | |
| [C-5] | |
| KBr | 1029 g |
| KI | 29.3 g |
| Distilled water was added to make 3500 ml. | |
| [D-5] | |
| Aqueous 1.75 N KBr solution | an amount for controlling the following silver potential |

By the use of a mixing stirrer described in Japanese Patent Publication No. 58288/1983, 64.1 ml of each of Solution B5 and Solution C5 were added to Solution A5 in 2 minutes in a reaction vessel at 35° C. by a double-jet method to form a nuclei.

After addition of Solutions B5 and C5 was stopped, the temperature of Solution A5 was elevated to 60° C. spending 60 minutes. Then, solutions B5 and C5 each were added by means of a double jet method for 50 minutes at a flow rate of 68.5 ml/min. During the addition the silver potential, which was measured by means of a silver ion selecting electrode and a saturated silver-silver chloride reference electrode, was regulated to +6 mv using Solution D5. After the addition, pH was regulated to 5.0 with 3% KOH. Immediately after that, it was desalted and washed in the same manner as in Seed emulsion A and gelatin was added to obtain a seed emulsion.

This seed emulsion was observed by an electron microscope and it was proved that this seed emulsion was composed of hexagonal tabular grains having an average thickness of 0.07 μm, an average diameter (converted to a circle) of 0.5 μm and a variation coefficient of 25%, 90% or more of the silver halide grains having a maximum adjacent edge ratio of 1.0 to 2.0.

(Preparation of silver iodobromide emulsion EM-4)

The tabular silver iodobromide emulsion EM-4 containing 1.3 mol % of silver iodide was prepared using the following Solutions A6 through E6.

| | |
|---|---|
| [A6] | |
| Ossein gelatin | 29.4 g |
| $H—(CH_2CH_2O)_m-[CH(CH_3)—CH_2O]_{17}-(CH_2CH_2O)_n—H$ (m + n = 5–7) (10% methanol solution) | 1.25 ml |

-continued

| | |
|---|---|
| Hexahedral tabular seed emulsion B amount equivalent to | 2.65 mol |
| Distilled water was added to make 3000 ml. | |
| [B6] | |
| 3.50 N aqueous $AgNO_3$ solution | 1760 ml |
| [C6] | |
| KBr | 730 g |
| Distilled water was added to make 3000 ml. | |
| [D6] | |
| Silver iodide fine gain emulsion amount equivalent to | 0.06 mol |
| [E6] | |
| Aqueous 1.75N KBr solution | an amount for controlling the following silver potential |

Using a mixing stirrer as described in Japanese Patent Publication No. 58-58288/1983, 658 ml of each of Solutions B6 and C6, and the total amount of Solution D6 were added to Solution A6 in a reaction vessel in 40 minutes at 60° C. by a triple-jet method so that the final addition rate is two times the rate of initial addition rate to grow grains and form a first covering layer.

Subsequently, the rest of Solutions B6 and C6 each were added by means of a double jet method in 70 minutes so that the final addition rate is 1.5 times the initial addition rate to grow grains and form a second covering layer. During the addition the silver potential was regulated to +5 mv using Solution D6. After the addition, the mixture was subjected to precipitation desalting and redispersed in the same manner as in EM-1.

The thus obtained Emulsion EM-4 was observed by an electron microscope and it was proved that this emulsion was composed of hexagonal tabular grains having an average diameter converted to a circle of 0.84 μm, an average thickness of 0.08 μm and a grain size variation coefficient of 22%, 90% or more of the total projected area of the silver halide grains having major face {111} and an adjacent edge ratio of 1.0 to 2.0.

(Chemical sensitization of silver halide emulsion)

Each of the emulsions EM-1 through EM-4 was subjected to the following sensitization. The resulting emulsion was redissolved at 50° C. (Step i), 20 minute after, sensitizing dye (5,5'-dichloro-1,1',3,3'-tetraethylbenzimidazolocarbocyanine) was added in an amount of 0.6 mmol per mol of silver in the form of solid fine particle dispersion (Step ii). Thirty minute after, Selenium sensitizer (triphenylphosphineselenide) dispersion, a mixture solution of ammonium thiocyanate, chloroauric acid and sodium thiosulfate were added (Step iii), and 40 minute after, the above-mentioned silver iodide fine grain emulsion was added in an amount of $4.0\times10^{-3}$ mol per mol of silver (Step iv). 4-Hydroxy-6-methyl-1,3,3a,7-tetrazaindene (TAI) was added in an appropriate amount for stabilizing (Step v). Thus, ripening was carried out for 2 hours. Regarding Emulsion E-2, L-ascorbic acid was added in an amount of $1.8\times10^{-3}$ per mol of silver at an addition time as shown in Table 4 and reduction sensitized.

Further, the water soluble polymer in the invention was added in an amount as shown in Tables 2 through 4 and at an addition time as shown in Tables 2 through 4.

The solid fine particle dispersion of a spectral sensitizer was prepared according to a method disclosed in Japanese Patent O.P.I. Publication No. 5-297496/1993.

The spectral sensitizer was added to water at 27° C. The resulting mixture was stirred at 3500 rpm for 30 to 120 minutes by means of a high speed stirrer (dissolver) to obtain a solid spectral sensitizing dye fine particle dispersion.

The above dispersion of a selenium sensitizer, triphenylphosphinselenide was prepared according to the following:

To 30 kg of a 50° C. ethyl acetate, 120 g of triphenylphosphinselenide was added, stirred and completely dissolved. In 38 kg of water, 3.8 kg of photographic gelatin were dissolved and 93 g of a 25 wt % sodium dodecylbenzene sulfonate aqueous solution were added. The above two solutions were mixed and dispersed at 50° C. through high speed dispersion apparatus equipped with a 10 cm dissolver at a dispersion blade periodical rate of 40 m/second for 30 minutes. Thereafter, the dispersion was stirred under reduced pressure to remove ethyl acetate and to give a residual ethyl acetate concentration of not more than 0.3 wt %. The resulting dispersion was added with water to make 80 kg. A part of the thus obtained dispersion was used for the above experiment.

(Preparation and Coating of Coating Solutions)

To each of the thus emulsions were added the following additives to obtain an emulsion layer coating solution. Further, a protective layer coating solution and a filter layer coating solution as described later were prepared. The above coating solutions were double layer coated at a coating speed of 120 m/minute on each side of a support by means of two slide hopper coaters in a silver content of 1.3 g/m$^2$ and in a gelatin content of 2.5 g/m$^2$ and dried for 2 minutes and 20 seconds. Thus, silver halide photographic light sensitive material sample Nos. 1 through 72 were prepared. An aqueous dispersion was prepared to contain 10 wt % of a copolymer of glycidylmethacrylate, methyl acrylate and butyl acrylate (50:10:49, weight ratio), and gelatin and the following filter dye were added to obtain a filter layer.

A blue colored 175 μm thick polyethylene terephthalate film having a density of 0.20 was coated with the following layer constitution. The layer constitution of the thus obtained samples is shown in Tables 2, 3 and 4.

TABLE 1

| Position of layers | Kinds of layers | Gelatin content per one side surface (g/m$^2$) |
|---|---|---|
| Upper layer | Protective layer | 0.8 |
| Intermediate layer | Emulsion layer | 1.5 |
| Lower layer | Filter layer | 0.2 |

Filter dye (Solid dispersion)

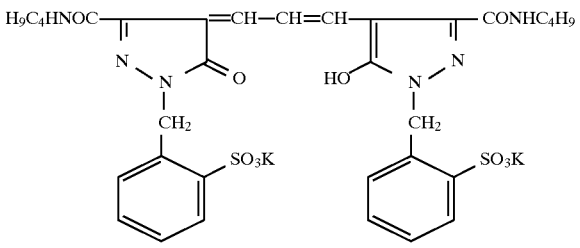

To each of the above obtained emulsions were added the following additives. The amount is in terms of a weight amount per mol of silver halide.

| | |
|---|---|
| 1,1-Dimethylol-1-bromo-1-nitromethane | 70 mg |
| t-Butyl-catechol | 400 mg |
| 2,6-bis(hydroxyamino)-4-dirthylamino -1,3,5-triazine | 0.15 mg |
| Polyvinyl pyrrolidone (molecular weight 10,000) | 1.0 g |
| Styrene-maleic acid anhydride copolymer | 2.5 g |
| Nitrophenyl-triphenyl phosphonium chloride | 50 mg |
| Ammonium 1,3-dihydroxybenzene-4-sulfonic acid | 2 g |
| 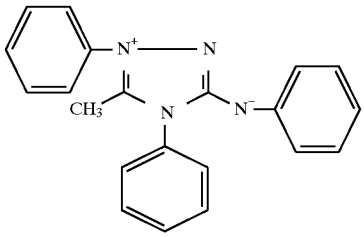 | 150 mg |
| 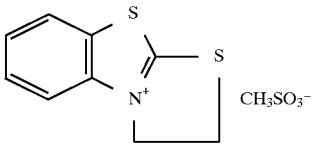 | 70 mg |
| $n\text{-}C_4H_9OCH_2CH(OH)CH_2N(CH_2COOH)_2$ | 1 g |
| 1-Phenyl-5-mercaptotetrazole | 15 mg |

Protective layer coating solution The following protective layer composition was prepared. The amount of the additives is in terms of a weight amount per liter of coating solution.

| | |
|---|---|
| Lime-processed inert gelatin | 68 g |
| Acid-processed gelatin | 2 g |
| Sodium-i-amyl-n-decylsulfosuccinate | 1 g |
| Polymethylmethacrylate Matting agent having an area average grain size of 3.5 $\mu$m) | 1.1 g |
| Silicon dioxide (an average grain size of 1.2 $\mu$m) | 0.5 g |
| $(CH_2{=}CHSO_2CH_2)_2O$ (Hardener) | 500 mg |
| $C_4F_9SO_3K$ | 2 mg |
| $C_{12}H_{25}CONH(CH_2CH_2O)_5H$ | 2.0 g |
| 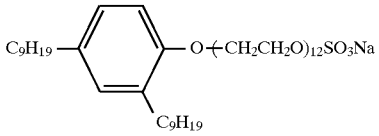 | 1.0 g |
| 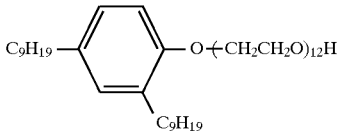 | 0.4 g |
| 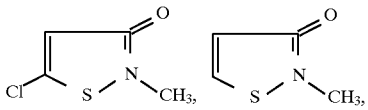 | 0.1 g |
| 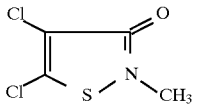 | |
| (50:46:4) | |

(Evaluation of Samples)

(1) Sensitometry

The photographic properties of the above obtained samples Nos. 1 through 66 were evaluated as follows:

Each sample was sandwiched between two intensifying screens KO-250 (produced by Konica Corporation), and exposed to X-ray through aluminum wedge at a tube potential of 80 kvp and at a tube current of 100 mA for 0.064 seconds. The resulting sample was processed using the following developer and fixer in a roller type automatic processor (SRX-503).

| Developer composition | |
|---|---|
| Part A (for 12 liter) | |
| Potassium hydroxide | 450 g |
| Potassium sulfite (50% solution) | 2280 g |
| Diethylene tetramine pentaacetate | 120 g |
| Sodium bicarbonate | 132 g |
| Boric acid | 40 g |
| 5-Methylbenzotriazole | 1.4 g |
| 5-nitrobenzoimidazole | 0.4 g |
| 1-Phenyl-5-mercaptotetrazole | 0.25 g |
| 4-Hydroxymethyl-4-methyl-1-phenylpyrazolidone | 120 g |
| Hydroquinone | 400 g |
| Water added to 6000 ml. | |
| Part B (for 12 liter) | |
| Glacial acetic acid | 70 g |
| 5-Nitroindazole | 0.6 g |
| N-acetyl-DL-penicillamine | 1.2 g |
| Starter | |
| Glacial acetic acid | 120 g |
| Potassium bromide | 225 g |
| $HO(CH_2)_2S(CH_2)_2S(CH_2)_2OH$ | 1.0 g |
| $CH_3N(C_3H_6NHCONHC_2HSC_2H_5)_2$ | 1.0 g |
| 5-Methylbenzotriazole | 1.5 g |
| Water added to 1000 milliliter. | |
| **Fixer composition** | |
| Part A (for 18300 milliliter) | |
| Ammonium thiosulfate (70 wt/vo %) | 4500 g |
| Sodium sulfite | 450 g |
| Sodium acetate.pentahydrate | 450 g |
| Boric acid | 110 g |
| Tartaric acid | 60 g |
| Sodium citrate | 10 g |
| Gluconic acid | 70 g |
| 1-(N,N-dimethylamino)ethyl-5-mercaptotetrazole | 18 g |
| Glacial acetic acid | 330 g |
| Aluminum sulfate | 62 g |
| Water added to 7200 milliliter. | |

Parts A and B of the developer composition were incorporated in 5 liter water while stirring and water was added to make 12 liter. The resulting developer was adjusted to pH 10.40 with glacial acetic acid. Thus, Developer replenisher was prepared.

To 1 liter of the developer replenisher were added 20 ml/liter of the starter described above and pH was adjusted to 10.30. Thus, developer to be used was obtained.

In preparing fixer, Part A of the fixer composition was incorporated in 5 liter water while stirring and water was added to make 18.3 liter. The resulting fixer was adjusted to pH 4.6 with sulfuric acid and NaOH. Thus, fixer replenisher was prepared.

Regarding processing temperatures, development temperature was 35° C., fixing temperature was 33° C., washing temperature was 20° C., and drying temperature was 50° C. The total processing time was 25 seconds in dry to dry time. The replenishing amount of the developer and fixer replenishers was 65 ml.

After the processing, sensitivity was measured. Sensitivity was represented by a reciprocal of exposure necessary to give a density of fog plus 0.5, and sensitivity of samples was represented in terms of sensitivity relative to sensitivity of Sample No. 1 being defined as 100. The results are shown in Tables 2 through 4.

(Evaluation of Image Tone)

Each sample was exposed to X-ray, and tone of the developed silver was evaluated. That is, the sample was exposed to X-ray from tube (tube voltage 120 Kvp) using chest phantom and fluorescent screens SRO-250 (produced by Konica Corporation) and processed in the same manner as in sensitometry described above.

The resulting sample was put on a viewing box and the developed silver tone was observed by the transmitted light. The evaluation criteria were as follows:

1: Yellowish black

2: Slightly yellowish black

3: Reddish black

4: Slightly reddish black

5: Pure black No. 1 cannot be put into practical use. No. 5 is excellent, and No. 4 and 5 are put into practical use.

(Evaluation of Scratch Resistance)

Each sample was further stored at 25° C. and 30% RH for one hour. Thereafter, the surface of a 2 $cm^2$ sample was rubbed with a commercially available nylon brush at a rate of 2 cm/second while applying a 100 g load. The resulting unexposed sample was processed using the above automatic processor. The number of blackened lines was counted. The results are shown in Tables 2 through 4.

(Evaluation of Processing Dependency)

Each sample was processed in the same manner as in sensitometry described above, except that the developer was changed to RD-3 (produced by Fuji Film Co., Ltd.), the fixer was changed to Fuji F (produced by Fuji Film Co., Ltd.), and the total processing time was 90 seconds in dry to dry time. The fog difference (ΔF) between fogs of the above samples processed at total processing times of 25 seconds and 90 seconds, and the sensitivity difference (ΔS) between sensitivities of the above samples processed at total processing times of 25 seconds and 90 seconds were calculated. When their values are smaller, the processing dependency is smaller and more excellent.

(Evaluation of Safelight Safety Characteristics)

Each sample was exposed to white light 1.3 m distant from the sample for 30 minutes, through a red filter having transmitting properties as shown in FIG. 1. The resulting sample was processed in the same manner as in sensitometry above. The fog increment was measured.

TABLE 2

| Sample No. | Emulsion No. | Synthetic water soluble polymer Addition step | Synthetic water soluble polymer No. | Synthetic water soluble polymer Addition amount | Sensitometry fog | Sensitometry Sensitivity S | Sensitometry Dmax | Safelight safety Fog ΔD | Silver image tone | Processing dependency Δfog | Processing dependency ΔS | Scratched line number | Remarks |
|---|---|---|---|---|---|---|---|---|---|---|---|---|---|
| 1 | EM-1 | None | — | — | 0.04 | 100 | 2.50 | 0.14 | 4 | 0.07 | +45 | 13 | Comp. |
| 2 | EM-1 | i | — | — | 0.06 | 62 | 2.50 | 0.08 | 3 | 0.08 | +20 | 14 | Comp. |
| 3 | EM-1 | ii | — | — | 0.06 | 75 | 2.50 | 0.08 | 3 | 0.08 | +25 | 15 | Comp. |
| 4 | EM-1 | iii | — | — | 0.04 | 70 | 2.48 | 0.07 | 3 | 0.07 | +21 | 12 | Comp. |
| 5 | EM-1 | iv | — | — | 0.06 | 85 | 2.49 | 0.08 | 3 | 0.07 | +32 | 14 | Comp. |
| 6 | EM-1 | v | — | — | 0.05 | 94 | 2.49 | 0.08 | 4 | 0.07 | +40 | 15 | Comp. |
| 7 | EM-2 | None | — | — | 0.05 | 83 | 2.83 | 0.25 | 2 | 0.09 | +27 | 33 | Comp. |
| 8 | EM-2 | i | — | — | 0.04 | 135 | 3.19 | 0.11 | 4 | 0.03 | +13 | 10 | Inv. |
| 9 | EM-2 | ii | — | — | 0.04 | 138 | 3.19 | 0.13 | 4 | 0.02 | +14 | 12 | Inv. |
| 10 | EM-2 | iii | — | — | 0.04 | 132 | 3.15 | 0.16 | 4 | 0.05 | +18 | 10 | Inv. |
| 11 | EM-2 | iv | — | — | 0.04 | 128 | 3.13 | 0.19 | 3 | 0.06 | +17 | 20 | Inv. |
| 12 | EM-2 | v | — | — | 0.04 | 112 | 2.99 | 0.17 | 3 | 0.09 | +20 | 24 | Inv. |
| 13 | EM-3 | None | — | — | 0.04 | 97 | 2.85 | 0.32 | 2 | 0.15 | +25 | 40 | Comp. |
| 14 | EM-3 | i | — | — | 0.03 | 143 | 3.19 | 0.10 | 5 | 0.03 | +8 | 8 | Inv. |
| 15 | EM-3 | ii | — | — | 0.03 | 140 | 3.20 | 0.12 | 4 | 0.03 | +6 | 12 | Inv. |
| 16 | EM-3 | iii | — | — | 0.04 | 120 | 3.17 | 0.15 | 4 | 0.07 | +10 | 10 | Inv. |
| 17 | EM-3 | iv | — | — | 0.04 | 118 | 3.13 | 0.13 | 4 | 0.09 | +14 | 13 | Inv. |
| 18 | EM-3 | v | — | — | 0.05 | 115 | 3.12 | 0.17 | 3 | 0.10 | +14 | 27 | Inv. |
| 19 | EM-4 | None | — | — | 0.05 | 121 | 3.02 | 0.37 | 3 | 0.15 | +34 | 46 | Comp. |
| 20 | EM-4 | i | — | — | 0.04 | 92 | 3.00 | 0.32 | 3 | 0.14 | +29 | 38 | Comp. |
| 21 | EM-4 | ii | — | — | 0.04 | 92 | 3.05 | 0.33 | 3 | 0.15 | +30 | 40 | Comp. |
| 22 | EM-4 | iii | — | — | 0.05 | 103 | 3.06 | 0.38 | 3 | 0.16 | +31 | 42 | Comp. |
| 23 | EM-4 | iv | — | — | 0.05 | 110 | 3.06 | 0.40 | 3 | 0.15 | +31 | 43 | Comp. |
| 24 | EM-4 | v | — | — | 0.04 | 110 | 3.05 | 0.34 | 3 | 0.15 | +25 | 41 | Comp. |

TABLE 3

| Sample No. | Emulsion No. | Synthetic water soluble polymer Addition step | Synthetic water soluble polymer No. | Synthetic water soluble polymer Addition amount | Sensitometry fog | Sensitometry Sensitivity S | Sensitometry Dmax | Safelight safety Fog ΔD | Silver image tone | Processing dependency Δfog | Processing dependency ΔS | Scratched line number | Remarks |
|---|---|---|---|---|---|---|---|---|---|---|---|---|---|
| 25 | EM-2 | i | — | — | 0.04 | 145 | 3.20 | 0.10 | 5 | 0.05 | 12 | 9 | Inv. |

TABLE 3-continued

| Sample No. | Emulsion No. | Synthetic water soluble polymer Addition step | Synthetic water soluble polymer No. | Synthetic water soluble polymer Addition amount | Sensitometry fog | Sensitometry Sensitivity S | Sensitometry Dmax | Safe-light safety Fog ΔD | Silver image tone | Processing dependency Δfog | Processing dependency ΔS | Scratched line number | Remarks |
|---|---|---|---|---|---|---|---|---|---|---|---|---|---|
| 26 | EM-2 | ii | — | — | 0.04 | 146 | 3.20 | 0.10 | 5 | 0.05 | 10 | 8 | Inv. |
| 27 | EM-2 | iii | — | — | 0.04 | 145 | 3.15 | 0.15 | 4 | 0.05 | 15 | 12 | Inv. |
| 28 | EM-2 | iv | — | — | 0.05 | 125 | 3.14 | 0.15 | 4 | 0.06 | 16 | 18 | Inv. |
| 29 | EM-2 | v | — | — | 0.06 | 125 | 3.18 | 0.19 | 3 | 0.06 | 16 | 25 | Inv. |
| 30 | EM-2 | i | — | — | 0.04 | 155 | 3.19 | 0.12 | 5 | 0.04 | 9 | 7 | Inv. |
| 31 | EM-2 | ii | — | — | 0.04 | 153 | 3.20 | 0.10 | 4 | 0.05 | 12 | 7 | Inv. |
| 32 | EM-2 | iii | — | — | 0.05 | 150 | 3.14 | 0.15 | 4 | 0.05 | 14 | 10 | Inv. |
| 33 | EM-2 | iv | — | — | 0.05 | 131 | 3.14 | 0.20 | 4 | 0.06 | 15 | 15 | Inv. |
| 34 | EM-2 | v | — | — | 0.06 | 127 | 3.15 | 0.20 | 3 | 0.07 | 18 | 22 | Inv. |
| 35 | EM-3 | i | — | — | 0.03 | 140 | 3.20 | 0.09 | 5 | 0.05 | 18 | 9 | Inv. |
| 36 | EM-3 | ii | — | — | 0.03 | 143 | 3.21 | 0.09 | 4 | 0.05 | 8 | 8 | Inv. |
| 37 | EM-3 | iii | — | — | 0.04 | 135 | 3.14 | 0.15 | 4 | 0.04 | 10 | 10 | Inv. |
| 38 | EM-3 | iv | — | — | 0.04 | 130 | 3.17 | 0.19 | 4 | 0.06 | 12 | 14 | Inv. |
| 39 | EM-3 | v | — | — | 0.06 | 127 | 3.15 | 0.20 | 3 | 0.07 | 20 | 24 | Inv. |
| 40 | EM-3 | i | — | — | 0.03 | 155 | 3.21 | 0.09 | 4 | 0.04 | 9 | 7 | Inv. |
| 41 | EM-3 | ii | — | — | 0.03 | 155 | 3.21 | 0.09 | 4 | 0.04 | 10 | 7 | Inv. |
| 42 | EM-3 | iii | — | — | 0.04 | 140 | 3.18 | 0.09 | 4 | 0.05 | 12 | 10 | Inv. |
| 43 | EM-3 | iv | — | — | 0.05 | 135 | 3.18 | 0.17 | 4 | 0.06 | 12 | 12 | Inv. |
| 44 | EM-3 | v | — | — | 0.06 | 120 | 3.18 | 0.24 | 4 | 0.07 | 15 | 26 | Inv. |

TABLE 4

| Sample No. | Emulsion No. | Synthetic water soluble polymer Addition step | Synthetic water soluble polymer No. | Synthetic water soluble polymer Addition amount | Reduction sensitization (Addition time) | Sensitometry fog | Sensitometry Sensitivity S | Sensitometry Dmax | Safe-light safety Fog ΔD | Silver image tone | Processing dependency Δfog | Processing dependency ΔS | Scratched line number | Remarks |
|---|---|---|---|---|---|---|---|---|---|---|---|---|---|---|
| 45 | EM-2 | None | — | — | i | 0.19 | 130 | 2.85 | 0.46 | 2 | 0.20 | 20 | 38 | Comp. |
| 46 | EM-2 | None | — | — | ii | 0.16 | 130 | 2.82 | 0.45 | 2 | 0.18 | 20 | 35 | Comp. |
| 47 | EM-2 | None | — | — | iii | 0.25 | 117 | 2.85 | 0.45 | 2 | 0.18 | 18 | 40 | Comp. |
| 48 | EM-2 | None | — | — | iv | 0.22 | 119 | 2.86 | 0.45 | 2 | 0.18 | 19 | 37 | Comp. |
| 49 | EM-2 | i | SP-1 | 3.5 g | i | 0.05 | 162 | 3.20 | 0.18 | 4 | 0.10 | 7 | 8 | Inv. |
| 50 | EM-2 | i | SP-1 | 3.5 g | ii | 0.05 | 169 | 3.18 | 0.15 | 5 | 0.12 | 7 | 10 | Inv. |
| 51 | EM-2 | i | SP-1 | 3.5 g | iii | 0.06 | 155 | 3.20 | 0.17 | 4 | 0.14 | 9 | 15 | Inv. |
| 52 | EM-2 | i | SP-1 | 3.5 g | iv | 0.06 | 152 | 3.20 | 0.15 | 4 | 0.15 | 9 | 13 | Inv. |
| 53 | EM-2 | ii | SP-1 | 3.5 g | ii | 0.05 | 165 | 3.20 | 0.16 | 4 | 0.14 | 9 | 7 | Inv. |
| 54 | EM-2 | ii | SP-1 | 3.5 g | iii | 0.05 | 159 | 3.22 | 0.15 | 4 | 0.15 | 7 | 12 | Inv. |
| 55 | EM-2 | ii | SP-1 | 3.5 g | iv | 0.06 | 147 | 3.20 | 0.15 | 4 | 0.15 | 9 | 15 | Inv. |
| 56 | EM-3 | iii | SP-1 | 3.5 g | iii | 0.06 | 154 | 3.18 | 0.18 | 4 | 0.13 | 10 | 10 | Inv. |
| 57 | EM-3 | iii | SP-1 | 3.5 g | iv | 0.08 | 150 | 3.21 | 0.20 | 4 | 0.13 | 12 | 12 | Inv. |
| 58 | EM-3 | iv | SP-1 | 3.5 g | iv | 0.08 | 152 | 3.24 | 0.20 | 4 | 0.20 | 12 | 15 | Inv. |

As is apparent from Tables 2 through 4, inventive samples give the excellent results even in rapid processing. The inventive samples give excellent silver image tone and improved scratch resistance and processing dependency. On the contrary, comparative, safelight safty samples was not satisfactory in some of the photographic properties.

What is claimed is:

1. A silver halide photographic light sensitive material comprising a support and provided thereon, at least one silver halide emulsion layer comprising tabular silver halide grains having a silver chloride content of not less than 50 mol % and two parallel major {100} faces and a water soluble polymer, wherein the silver halide grains have been sensitized in the presence of $1\times10^{-2}$ to 50 g/mol of Ag of said water soluble polymer, and said water soluble polymer has a water solubility of not less than 0.05 g based on the 100 g of 20° C. water and is a synthetic water soluble polymer having in its molecule in an amount of 10 to 100 mol % a repeating unit represented by the following Formula (P):

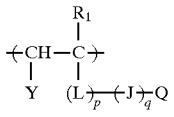

wherein $R_1$ represents a hydrogen atom, an alkyl group, a halogen atom or —$CH_2COOM$; L represents —CONH—, —NHCO—, —COO—, —OCO—, —CO—, or —O—; J represents an alkylene or arylene group or —$(CH_2CH_2O)_m(CH_2)_n$— in which m represents an integer of 0 to 40 and n represents an integer of 0 to 4; O represents a hydrogen atom, an alkyl group having 1 to 20 carbon atoms,

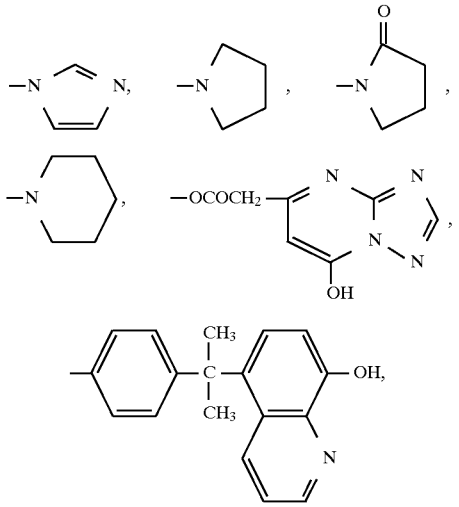

$—N^+(R_4)(R_5)(R_6)X^-$, $—N(R_7)(R^8)$, —OM, $—NH_2$, $—SO_3M$, —O—P(=O) $(OM)_2$ or $—C(=O)R_2$ in which M represents a hydrogen atom or a cation, $R_2$ represents an alkyl group having 1 to 4 carbon atoms, and $R_4$, $R_5$, $R_6$, $R_7$ and $R_8$ independently represent an alkyl group having 1 to 20 carbon atoms; X represents an anion; Y represents a hydrogen atom or a carboxy group; and p and q independently represent 0 or 1.

2. The material of claim 1, wherein said $R_1$ represents a hydrogen atom or a methyl group; said L represents —OCO— or —O—; and said Q represents $—SO_3M$, —O—P(=O) $(OM)_2$ or $—C(=O)R_2$ in which M represents a hydrogen atom or a cation and $R_2$ represents an alkyl group having 1 to 4 carbon atoms.

3. The material of claim 1, wherein said water soluble polymer is added at or after addition of a reduction sensitizer.

4. The material of claim 3, wherein said reduction sensitizer is ascorbic acid or its derivatives.

5. The material of claim 4, wherein said ascorbic acid or its derivatives are added in an amount of $5\times10^{-5}$ to $1\times10^{-1}$ mol per mol of silver halide.

* * * * *